United States Patent [19]

Zamma et al.

[11] 4,431,049

[45] Feb. 14, 1984

[54] BAYONET TUBE HEAT EXCHANGER

[75] Inventors: Jun Zamma, Yachiyo; Yoshinori Nishimura, Chiba; Youichi Nakajima, Chiba; Tadaaki Sakai, Chiba, all of Japan

[73] Assignee: Toyo Engineering Corporation, Japan

[21] Appl. No.: 196,626

[22] Filed: Oct. 14, 1980

[30] Foreign Application Priority Data

Nov. 27, 1979 [JP] Japan ..... 54-152432

[51] Int. Cl.[3] ..... F28D 7/12; F28F 9/02

[52] U.S. Cl. ..... 165/142; 165/83; 165/158

[58] Field of Search ..... 165/142, 158, 82, 83

[56] References Cited

U.S. PATENT DOCUMENTS

| | | | |
|---|---|---|---|
| 1,014,140 | 1/1912 | Gainer | 165/142 |
| 2,357,156 | 8/1944 | Wilson | 165/142 |
| 2,423,697 | 7/1947 | Garfield | 165/176 |
| 2,499,608 | 3/1950 | Rink | 165/142 |
| 3,201,938 | 8/1965 | Zirin | 165/142 X |
| 3,850,231 | 11/1974 | Creek | 165/158 X |
| 4,078,899 | 3/1978 | Keller et al. | 165/142 X |
| 4,142,580 | 3/1979 | Bailey | 165/142 |
| 4,193,447 | 3/1980 | Fah | 165/142 X |
| 4,220,200 | 9/1980 | Weber | 165/142 |

FOREIGN PATENT DOCUMENTS

| | | | |
|---|---|---|---|
| 1000840 | 1/1957 | Fed. Rep. of Germany | 165/142 |
| 122563 | 1/1919 | United Kingdom | 165/142 |
| 1532757 | 11/1978 | United Kingdom | 165/142 |

*Primary Examiner*—Sheldon J. Richter
*Attorney, Agent, or Firm*—McGlew and Tuttle

[57] ABSTRACT

A heat exchanger according to the present invention is provided with bayonet tubes in its shell. One end of each of bayonet tube outer ducts is secured to and open at a tube sheet fixed at one end of the shell. One end of each of bayonet tube inner ducts is secured to and opened to a hot gas separation chamber. The other ends of inner and outer duct communicate with each other. A hot gas separation chamber is provided inside the tube side pressure drum which is attached to and in contact with the tube sheet. Such construction of a heat exchanger according to the invention as this prevents thermal stress from arising, rendering the design of economical and reliable heat exchangers possible.

4 Claims, 4 Drawing Figures

BAYONET TUBE HEAT EXCHANGER

BACKGROUND OF THE INVENTION

The present invention relates to an improved heat exchanger using bayonet tubes and more particularly an improved heat exchanger free of thermal stress, comprising bayonet tube outer ducts which are open at and secured to a tube sheet of the heat exchanger and bayonet tube inner ducts which are open to and secured to a high temperature fluid separation chamber of the heat exchanger.

In chemical plants, heat exchangers are used for the recovery of heat from high temperature gas generated as a result of burning, a reaction or the like.

Normal heat exchangers conventionally used are such as those shown in FIG. 1, and comprise a shell 1 containing a plurality of tubes 2 therein, the ends of the shell 1 being enclosed by tube sheets 3, 3 with the tubes 2 passing through the tube sheets and opened to chambers which are enclosed by the stationary heads 4,4 and the tube sheets 3,3. The shell 1 is provided with an inlet nozzle 5 and an outlet nozzle 6 for the first fluid. The stationary head 4 on one side of the shell is provided with an inlet nozzle 7 for the second fluid, and the stationary head 4 on the other side is provided with an outlet nozzle 8 for the second fluid. When heat exchangers of this type are used, the shell 1 is in contact with the first fluid, while the tubes 2 are in contact with the second fluid. Therefore the temperature difference therebetween causes a change in relative thermal expansion between the shell 1 and the tubes 2. Thermal stress is thereby induced at the connection between the tubes 2 and the tube sheets 3 and at the connection between the shell 1 and the tube sheets 3. The temperature difference also exists between the inner and outer surfaces of the tube sheets 3. The thermal stress caused by those temperature conditions often makes the design of heat exchangers of this type difficult. Further, the places where thermal stress arises as mentioned above are located where inspection as well as repair is difficult to perform.

In order to absorb the thermal expansion it is possible to provide the middle portion of the shell with an expansion joint 9. However, if the first fluid is a hot gas, insulation materials which are lined on the shell wall would separate therefrom due to the expansion and contraction of the shell 1. And if the aforementioned first fluid is water, high pressure steam exceeding 100 atoms is normally generated, thereby rendering the mechanical design of expansion joints very difficult.

Another type of conventionally used heat exchangers is shown in FIG. 2. It comprises a shell 1 having an inlet nozzle 5 and an outlet nozzle 6 for the first fluid wherein U tubes 2*a* are contained, the ends of the U tubes 2*a* passing through a tube sheet 3 and being open to a chamber defined by a tube sheet 3, a stationary head 4*a* and a chamber cover 4*b*. The chamber is separated into two volumes by a pass partition 10, one volume being provided with an inlet nozzle 7 for the second fluid and an open port of one end of each of the U tubes 2*a*, the other volume being provided with an outlet nozzle 8 for the second fluid and an open port of the other end of each of the U tubes 2*a*. In this case, there is no problem of thermal expansion which is caused by the temperature difference between the shell 1 and the U tubes 2*a*, but since the chamber is divided into two volumes by the pass partition 10, the hot second fluid flows into one volume, and the cold second fluid after exchanging heat flows into the other volume, the big temperature difference prevailing along the tube sheet 3, causing thermal stress to arise therein, which makes the selection of structural materials and establishment of safe design very difficult.

BRIEF SUMMARY OF THE INVENTION

The object of the present invention is to solve the aforementioned problem and provide a safe and economic heat exchanger of novel design, which uses bayonet tubes and a chamber for fluid before heat exchanging, a chamber for fluid after heat exchanging.

Another object of the present invention is to eliminate the thermal stress caused by the difference of thermal expansion between tubes and a shell, permitting a design using tube sheet and a shell and using low cost materials other than high grade steel.

Still another object of the present invention is to provide a light weight and low cost heat exchanger, which can be designed with the rational use of thermal insulation material to operate in the temperature range where the material strength is not lowered.

DETAILED DESCRIPTION OF THE INVENTION

Figure 1:
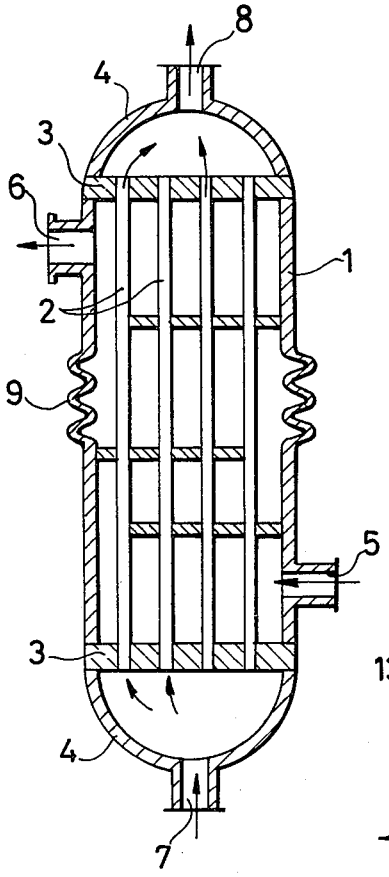
PRIOR ART FIG. 1
FIG. 1 shows a schematic section of an example of conventional heat exchangers.
Figure 3:
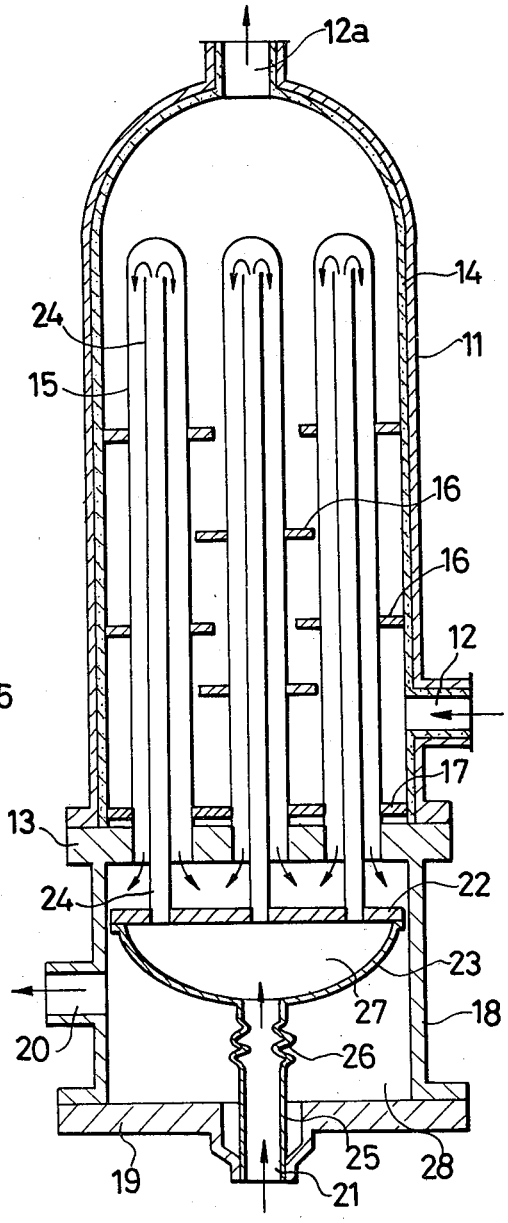
FIG. 3 is a schematic section of an embodiment of heat exchangers according to the present invention.

The invention will now be described by way of several embodiments with reference to the accompanying drawings. In FIG. 3 is shown a schematic section of an embodiment of heat exchangers according to the present invention. This is an embodiment of heat exchanger which uses hot gas for the first fluid and high pressure cold gas for the second fluid. The device generally comprises a cylindrical shell 11 which is provided with an inlet nozzle 12 and outlet nozzle 12*a* for the first fluid and is enclosed except the outlet nozzle 12*a* at one end and connected to a tube sheet 13 at the other end. Normally Cr-Mo steel, heat resisting steel or the like is used for the shell 11, the inside of which is lined normally with heat insulation material 14 if the operating temperature exceeds the upper limit for the material used. The shell 11 contains a plurality of bayonet tube outer ducts 15, one end of each of which passes through the tube sheet 13 and is secured to the tube sheet 13, opened to the outside of the shell 11, while the other end thereof is closed. Inside the shell 11 are provided a plurality of baffle plates 16 for controlling the flow of the first fluid, and a shroud 17 adjacent to the tube sheet 13. The side of the tube sheet 13 opposite to the shell 11 is connected to a stationary head 18, the end of which is enclosed by a chamber cover 19, with the tube sheet 13, the stationary head 18 and the chamber cover 19 altogether forming a tube side pressure chamber 28. The stationary head 18 is provided with an exit nozzle 20 for the second fluid, and the chamber cover 19 is provided with an inlet nozzle 21 for the second fluid. Inside the tube side pressure chamber 28 is formed a hot gas separation chamber 27 which is separated therefrom by the tube sheet 22 and head cover 23. Bayonet tube inner ducts 24 connected to the hot gas separation chamber 27 are inserted through the tube sheet 22 into the bayonet tube outer ducts 15, with an annular space being provided between the inner ducts 24, and outer ducts 15. The open end of each of the inner ducts 24 inside the outer ducts 15 is provided with a clearance from the end of each of the outer ducts 15 permitting fluid to flow, while the other end of inner duct 24 at the side of tube sheet 22 is opened to the hot gas separation chamber 27. The hot gas separation chamber 27 is connected to the inlet nozzle 21 for the second fluid through a gas inlet duct 25, which is provided with an expansion joint 26 if necessary.

In the heat exchanging operation with the aforementioned heat exchanger, hot gas as the first fluid is introduced through the inlet nozzle 12 into the shell 11, flows through the inter-duct spaces defined by the outer ducts 15, and while changing its direction of flow by the baffle plates and being cooled through heat exchanging, leaves the device through the outlet nozzle 12*a* for the first fluid.

On the other hand, high pressure cold gas enters into the hot gas separation chamber 27 through the inlet nozzle 21 for the second fluid, flows into the bayonet tube inner ducts 24 opening at the tube sheet 22 and out through the other ends of the ducts 24 into the outer ducts 15, proceeds through the annular spaces between the innerducts 24 and the outer ducts 15 while exchanging heat with the first fluid through the wall of the outer ducts 15 and being heated up, flows further into the tube side pressure chamber 28 through the openings at the tube sheet 13, and leaves the device from the outlet nozzle 20 for the second fluid.

Figure 2:
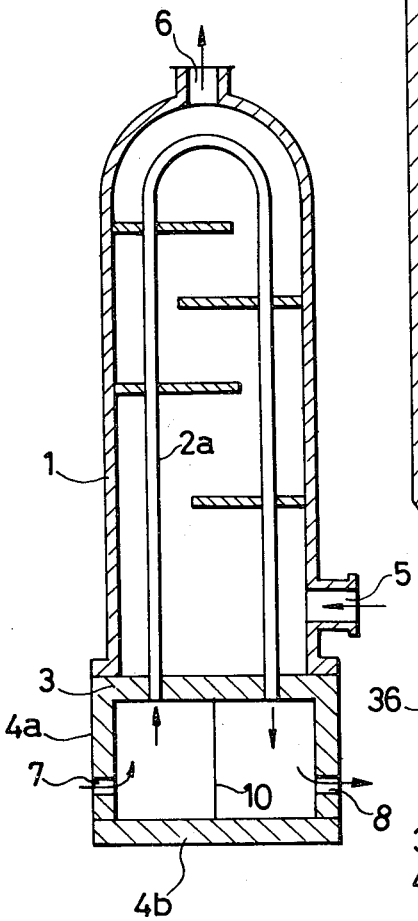
PRIOR ART FIG. 2
FIG. 2 is a schematic section of another example of conventional heat exchangers.

Now the hot gas separation chamber 27, which is contained inside the tube side pressure chamber 28, is exposed to the high pressure second fluid on its inner wall surface as well as its outer wall surface, the pressure difference between the inside and outside of the chamber 27 being equal to the pressure drop of the second fluid flowing through the inner ducts 24 and outer ducts 15. The hot gas separation chamber 27 therefore can be constructed with thin plates, being made extremely light weight, since the strength of the gas separation chamber 27 needs only to withstand the pressure equivalent to the aforementioned pressure drop. The fluid inlet duct 25 and the expansion joint 26 can also be made of thin materials as well. The arrangement of flowing the same fluid in the inner duct and reversely in the space between the inner and outer duct sometimes is not preferred from the point of performance design of heat exchangers. In those cases, thermal loss can be prevented by using thermally insulated tubes for the inner ducts 24 such as a ceramic or composite tube which consists of two coaxial tubes filled with insulated material therebetween. Single or multiple shrouds 17 installed inside the shell 11 can restrict convective heat transfer of hot gas as the first fluid to the wall of tube sheet, preventing excessive temperature rise on the wall of the shell side of the tube shell 13. The temperature of high pressure gas as the second fluid at the location where it passes through the tube sheet 13 after being heated is generally lower than the temperature of hot gas as the first fluid at the outlet nozzle 12*a* of the shell 11, and such irregular temperature gradient does not occur in the tube sheet 13 as in the device in FIG. 2 using U tubes 2*a*, and therefore excessive thermal stress is not induced in the tube sheet designed for high pressure. Further the shell 11 and the group of ducts 24 are thermally insulated by the bayonet tubes, so the thermal stress due to the difference in thermal expansion does not occur.

In case the excessively high temperature of hot gas as the first fluid as an adverse effect on the tube sheet 13, it may be necessary to reverse the direction of flow of the fluids to the heat exchanger. It will be explained hereunder, using FIG. 3. Hot gas is let in through the outlet nozzle 12*a*, exchanges heat through the bayonet tube outer ducts 15 and, after changing its direction by the baffle plates 16 and being cooled, flows out of the device through the inlet nozzle 12. On the other hand, high pressure cold gas is introduced into the device through the outlet nozzle 20, flows through the annular openings provided at the tube sheet 13 between the outer ducts 15 and inner ducts 24 of the bayonet tubes into the annular spaces between the above two ducts and, after exchanging heat with the hot gas, enters into the hot gas separation chamber 27 through the inner ducts 24, leaving the device through the inlet nozzle 21. When this method is used, the tube sheet 13 is exposed to the hot gas after cooling and to the high pressure cold gas before exchanging heat, thus preventing excessive temperature rise on the tube sheet 13. Moreover, the use of the aforementioned shroud 17 can further suppress the temperature rise, thereby preventing problems of design and materials from arising.

Figure 4:
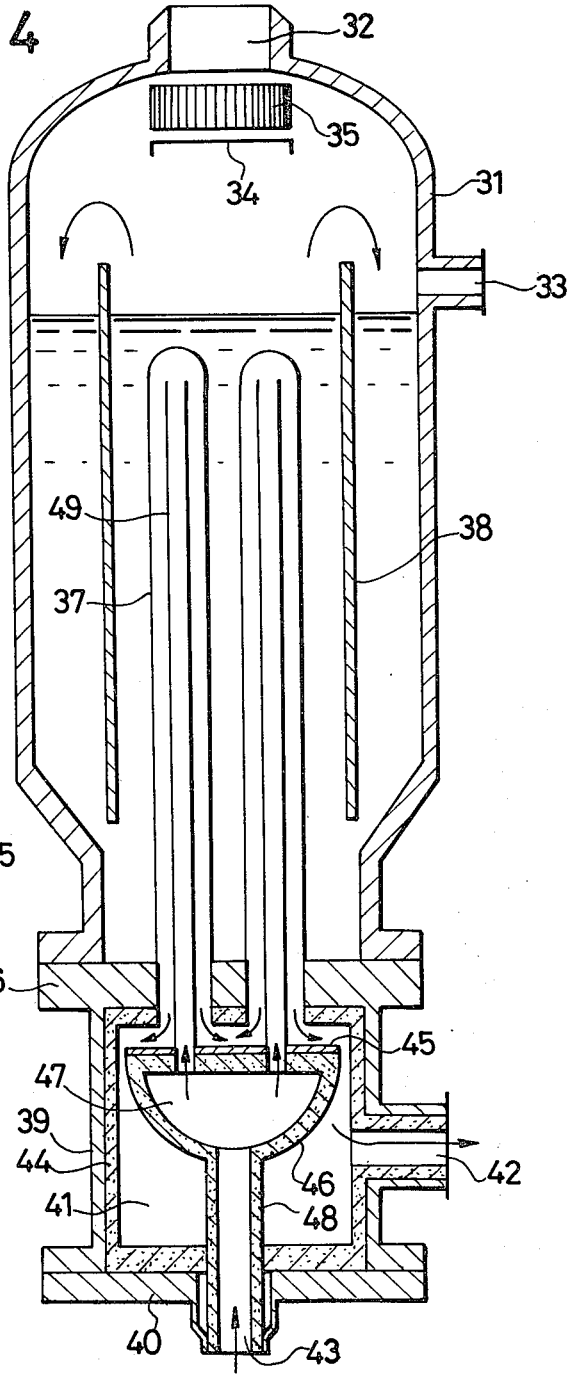
FIG. 4 is a schematic section of another embodiment of heat exchangers according to the present invention.

Now the second embodiment of the present invention will be described hereunder, with reference to FIG. 4. This embodiment is a vertical waste heat boiler of the integral steam drum type.

The boiler generally comprises a cylindrical pressure proof shell 31 which is provided with a steam outlet nozzle 32 and a water feed nozzle 33. Inside the shell 31 are provided an impact plate 34 and demister 35 near the lower end of the steam outlet nozzle 32. The lower end of the shell 31 is connected to a tube sheet 36, through which a plurality of bayonet tube outer ducts 37 pass, with the ducts 37 being secured to the tube sheet 36. The bayonet tube outer ducts 37 extend into the inside of the shell 31, the ends of the outer ducts 37 being closed and the other ends thereof being open at the lower surface of the tube sheet 36. Inside the shell 31 is provided an inner shell 38 encircling the group of bayonet tubes with a clearance about them. At the underside of the tube sheet 36, a tube side pressure chamber 41 is formed by a stationary head 39 and a chamber cover 40. The stationary head 39 is provided with a hot gas outlet nozzle 42 and the chamber cover 40 is provided with a hot gas inlet nozzle 43. The inner wall surface of the tube side pressure chamber 41 is usually lined with insulation materials 44. The tube side pressure chamber 41 contains inside thereof a hot gas separation chamber 47 which is enclosed by a thin tube sheet 45 and a head cover 46, the bottom of the head cover 46 being connected to the hot gas inlet nozzle 43 through the gas inlet pipe 48. A plurality of bayonet tube inner ducts 49 are secured to the thin tube sheet 45 and opened to the hot gas separation chamber 47, the inner ducts 49 extending to the upper side of the tube sheet 36 and being inserted inside the outer ducts 37 with an annular space provided therebetween, with the top end of the inner ducts 49 leaving a clearance from the closed top end of the outer ducts 37 to admit gas flow. The hot gas separation chamber 47 and the hot gas inlet pipe 48 are usually covered with insulation materials.

In the operation of this embodiment of waste heat boiler, water is put in the interior of the shell 31, and hot gas which is introduced through the hot gas inlet nozzle 43 flows through the inner ducts 49, which are opened to the hot gas separation chamber 47, into the annular spaces between the inner ducts 49 and outer duct 37 from the top end of the inner ducts 49 and, after exchanging heat with water in the shell 31 through the wall of the outer ducts 37, enters into the tube side pressure chamber 41 through annular openings provided on the tube sheet 36, leaving the device through the gas outlet nozzle 42. Steam generated by waste heat, which is applied from hot gas through the outer ducts 37, is accompanied by water, flows upward in two phase flow of steam and water in the space between the outer ducts encircled by the inner shell 38, and hits against the impact plate 34, with steam being separated upward from water and flowing through the demister 35 and the steam outlet nozzle 32 to leave the device. Water drops separated from steam by the impact plate 34 go downward in the annular portion between the inner shell 38 and the shell 31 and, together with water supplied through water feed nozzle 33, flows down and enters between the bottom of inner shell 38 and the tube sheet 36 toward the plurality of bayonet tubes inside the inner shell 38.

In spite of the fact that hot gas flows in the tubes of the device, the tubes are made free to expand and contract through the use of bayonet tubes and hot gas separation chamber and so no thermal stress is induced, which are conventionally caused by the difference of thermal expansion between the tubes and the shell. Further the hot gas separation chamber 47 is contained in the interior of the tube side pressure chamber 41, permitting the provision of a mechanical design based on the pressure drop, thereby leading to the construction of an extremely light weight device. The hot gas separation chamber 47 also is independent from the tube side pressure chamber 41, giving no thermal effect on the tube side pressure chamber 41 if provided with some amount of insulation work.

For instance, even in the case of ammonia plant where reformed gas has a temperature about 1000° C., the tube side pressure chamber 41 and the tube sheet 36 can be designed on the basis of an exit gas temperature of about 500° C. Further, if thermal insulation is provided on the inner wall of stationary head 39, it can be constructed with Cr-Mo steel or C½ Mo steel even though the involvement of hydrogen fume is taken into consideration, rendering the use of expensive heat resistant steel unnecessary. The aforementioned advantage of the present invention, as well as the fact that only small temperature gradient arises in a thick tube sheet 36 of high pressure steam drum, makes possible the construction of tube side pressure chamber and tube sheet for such high pressure as 250–350 kg/cm$^2$ of synthesis gas in a ammonia synthesis loop.

The present invention can be applied to a horizontal waste heat boiler, in which a steam drum is separated, it being possible to take this configuration if required from the layout of equipment and ease of maintenance.

As mentioned above, in a heat exchanger according to the present invention, such construction is used to permit free thermal expansion of a duct group of bayonet tubes relative to its drum so that the thermal stress caused by the difference in thermal expansion between the tubes and shell is prevented and a thick tube sheet in contact with a shell is not exposed to high temperature and has uniform temperature distribution, making the design and selection of material very advantageous. Furthermore, the tube side pressure chamber is thermally separated from the second fluid by the provision of a hot gas separation chamber, and therefore structural design and prevention of corrosion are made much easier. The hot gas separation chamber also can be structurally designed on the basis of differential pressure of the second fluid across a heat exchanger and additionally, the use of thermal insulation permits the design for temperature range where material strength is not lowered. All this leads to the construction of a light weight and low cost heat exchanger. As the fluid temperature is made the same at each port position of the tube sheet, the formation of excessive temperature gradient can be avoided, and the temperature of the tube plate is made lower than that of cooled gas atmosphere by selecting the direction of fluid flow, making the design of safe heat exchangers possible.

What is claimed is:

1. A heat exchanger comprising:

a pressure proof cylindrical shell having inlet and outlet nozzles for a first fluid and defining a first fluid space;

a first tube sheet connected to said shell to close said first fluid space;

a group of bayonet tube outer ducts connected in said shell, one end of each of said outer ducts being closed and another end thereof passing through and being open at said first tube sheet which is secured to one end of said shell;

a group of bayonet tube inner ducts inserted in said group of outer ducts, with an annular space being provided between each of said outer and inner ducts and clearance being provided at the closed end of each of said outer ducts to permit each of said inner ducts to communicate with said annular space;

only a single inner duct located in only a single outer duct defining each one of a plurality of duct assemblies;

a tube side pressure chamber provided in contact with said first tube sheet and which has an outlet nozzle for a second fluid; and a hot gas separation chamber for the second fluid, disposed in said tube side pressure chamber, said hot gas separation chamber having a second tube sheet spaced inwardly from said first tube sheet and from said side pressure chamber, one end of each of said group of inner ducts connected to said second tube sheet and being opened to the inside of said hot gas separation chamber which also communicates with an inlet nozzle for the second fluid through an inlet duct connected to said hot gas separation chamber, the second fluid adapted to be introduced into said hot gas separation chamber and to flow through said inner ducts and said annular space between said inner and outer ducts, thereby exchanging heat with the first fluid;

said hot gas separation chamber connected to said side pressure chamber only at said inlet duct of said hot gas separation chamber.

2. A heat exchanger according to claim 1, characterized in that a shroud is provided adjacent to the inner wall of said tube sheet.

3. A heat exchanger according to claim 1, characterized in that an expansion joint is provided in said gas inlet tube between said hot gas separation chamber and said inlet nozzle for the second fluid.

4. A heat exchanger according to claim 1, characterized in that a plurality of baffle plates are provided inside said shell to control the flow of the first fluid.

* * * * *